United States Patent [19]

Riley

[11] Patent Number: 4,919,109

[45] Date of Patent: Apr. 24, 1990

[54] PACK KITCHEN WITH AIRTIGHT STOVE AND FLUE OVEN

[76] Inventor: M. Orville Riley, P.O. Box 817, Townsend, Mont. 59644

[21] Appl. No.: 170,947

[22] Filed: Mar. 21, 1988

[51] Int. Cl.[5] ..... F24C 1/16

[52] U.S. Cl. ..... 126/9 R; 126/17; 126/18; 126/34; 126/59; 126/65; 126/77; 126/19 R; 126/37 R; 126/37 B; 312/228; 312/236; 312/328; 108/65

[58] Field of Search ..... 126/9 R, 9 B, 17, 18, 126/34, 26, 27, 28, 58, 59, 60, 62, 64, 65, 66, 77, 37 R, 37 B, 83, 31, 19 R, 29, 25 R; 312/237, 314, 315, 316, 317 R, 317 A, 228; 108/64, 65, 74, 77, 79, 152, 113, 114

[56] References Cited

U.S. PATENT DOCUMENTS

| | | | |
|---|---|---|---|
| 322,580 | 7/1885 | Burkhard | 126/25 R |
| 378,615 | 2/1888 | Peyton | 126/17 |
| 582,363 | 5/1897 | Myers | 126/9 R |
| 617,122 | 1/1899 | Ray . | |
| 697,091 | 4/1902 | Kistler | 126/332 |
| 700,356 | 5/1902 | Mitchell . | |
| 765,140 | 7/1904 | Keep | 126/34 X |
| 804,596 | 11/1905 | Gohman | 126/98 |
| 878,862 | 2/1908 | Boughton | 126/9 R |
| 900,821 | 10/1908 | Berry | 126/9 R |
| 1,011,698 | 12/1911 | Woollett | 126/1 F |
| 1,040,119 | 10/1912 | Baxter | 126/9 R |
| 1,115,063 | 10/1914 | Garey | 126/31 |
| 1,478,371 | 12/1923 | Albrighton | 312/314 |
| 1,545,494 | 6/1924 | Holl | 126/9 R |
| 1,821,658 | 9/1931 | McCormick | 432/249 |
| 2,129,371 | 9/1938 | Robinson | 126/9 R |
| 2,485,667 | 10/1949 | Sims | 126/9 R |
| 2,596,663 | 5/1952 | Duffy | 108/69 |
| 2,867,471 | 1/1959 | Coon | 126/9 B X |
| 2,922,414 | 1/1960 | Brender | 126/306 X |
| 2,944,862 | 7/1960 | Heil | 312/315 X |
| 3,056,396 | 10/1962 | Hochhalter et al. . | |
| 3,809,051 | 5/1974 | Giroux | 126/9 R |
| 3,915,529 | 10/1975 | Bernier | 126/37 B X |
| 4,082,391 | 4/1978 | Turner | 126/378 B X |
| 4,181,116 | 1/1980 | Sedore | 126/65 |
| 4,186,718 | 2/1980 | Goodwin | 126/66 X |
| 4,494,525 | 1/1985 | Albertsen | 126/77 X |

FOREIGN PATENT DOCUMENTS

| | | | |
|---|---|---|---|
| 517779 | 2/1940 | United Kingdom | 126/211 |

*Primary Examiner*—Carl D. Price
*Attorney, Agent, or Firm*—Douglas L. Tschida

[57] ABSTRACT

A sheet metal constructed modular pack kitchen including utility tables, sinks and cabinetry, along with an airtight wood stove and flue-mounted oven. When disassembled, the components self-store in nested relation within one another. The stove includes an airtight non-warping cook top, hollow double bottom, hinged hot water tank and supports a double-walled, damper-controlled oven and warming shelf. Slip-mounted, interlocking cook top and flue/oven sections provide a knock-down, airtight construction.

7 Claims, 5 Drawing Sheets

PACK KITCHEN WITH AIRTIGHT STOVE AND FLUE OVEN

BACKGROUND OF THE INVENTION

The present invention relates to collapsible pack kitchens which may be disassembled and self-stored in nested relation within one or more primary components and, in particular, to a modular, sheet metal constructed kitchen including an improved airtight wood stove having an appurtenant hinged water tank and flue-mounted oven.

Ranchers, outfitters and sheepherders, not to mention recreational users, are faced with the problems of living in the outdoors in temporary quarters which must be moved from day to day when following the herd, game or fish. Where terrain allows, trailered vehicles or more permanent base camps may be established and from which spike or temporary camps may be arranged as needed. However, it is desirable that any such camp, temporary or permanent, provide as many conveniences as possible.

In particular and as these conveniences relate to the amenities of eating and warmth, it is desirable that as complete a kitchen as possible be provided, along with an easily controlled and maintained stove/oven. Appreciating the necessity of moving camp, it is also preferable the construction of any such kitchen lend itself to as many modes of transport as possible, be it horseback, trailer, pickup truck or snowmobile. Where such transport means, though, is either a horse, boat or the like, it is especially preferable the camp disassemble to a relatively few number of compact components.

The present invention is therefore directed to a modular self-storing camp kitchen which is usable for the above-mentioned applications, although providing a number of advantages over heretofore known kitchens. In this latter regard, it is to be appreciated a variety of sheet metal constructed modular kitchen components have been developed over the years for use in similar settings. To the extent Applicant is aware of various predecessor stove constructions, a variety of stoves exhibiting ostensive non-warping or non-buckling cooking surfaces may be found upon reference to U.S. Pat. Nos. 322,580, 804,596; 1,821,658; and 4,181,116. A variety of collapsible stove constructions may also be found upon directing attention to U.S. Pat. Nos. 582,363; 617,122; 700,356; 878,862; 2,129,371; 2,485,667; 2,922,414; and 3,056,396.

The latter stove constructions, however, are directed to non-airtight stoves which are principally concerned with disassembly to as small a package as possible. Accordingly, such constructions are not perceived as lending themselves to airtight operation, which is preferred; particularly because such operation minimizes wood consumption, while maximizing heat transfer and thereby overall reducing the labor expenditure necessary to maintain an adequate firewood supply and operate the kitchen.

Still other components that find use with camp kitchens are appurtenant ovens for baking rolls, pies, etc., and hot water storage tanks which facilitate many other camp chores. In these latter regards, Applicant is aware of U.S. Pat. No. 1,011,698 which discloses a gas-heated oven. Also various ones of the foregoing stoves disclose multi-compartmented constructions having separate firebox and oven compartments.

As to the stove-mounted hot water tanks, Applicant is also aware of U.S. Pat. No. 1,040,119 which discloses a tank that mounts to an adjacent stove via provided keyhole slots. Such a mounting is perceived as being disadvantageous, though, in that water temperature is controllable only by way of fire size. More often than not, though, it is preferred to maintain as large a fire as possible, while controlling the water temperature at something less than boiling.

SUMMARY OF THE INVENTION

The subject invention is accordingly directed to an improved, modular, sheet metal constructed camp kitchen including a particularly improved airtight stove and associated flue-mounted oven. Controlled heating-/cooking fires are obtainable therewith without excessive firewood requirements and in a configuration lending itself to pack transport.

It is accordingly a primary object of the present invention to make available a number of modular, sheet metal constructed kitchen units which may be organized and arranged depending upon a user's needs.

It is a further object of the invention to provide a construction which may be disassembled and, in part, self-stored to accommodate transport on a pack animal.

It is a further object of the invention to provide an airtight wood stove which provides for a non-warping, radiant cooking surface, along with a thermally cooled double-bottom construction.

It is a further object of the invention to provide an associated airtight slip fastened, flue-mounted, dampered oven which may be mounted in overlying relation to the stove.

It is still another object of the invention to provide a hot water tank mounting that accommodates a thermal control of the water temperature.

The above objects, advantages and distinctions of the invention are particularly achieved in a number of modularly configured, formed sheet metal constructions of utility tables, sinks and cabinetry, along with an improved stove and oven. The tables are configured in a folding construction including slip fastened leg members, which leg mounting is similarly shared by the other units. The sinks are constructed of a formed work surface including one or more apertures for receiving available plastic tub or basin inserts. The cabinets, in turn, provide adjustable shelving along with folding handles.

The stove is constructed about a multi-segmented top and double-bottom configuration which provides for a radiant, non-warping cooking surface and through which a slip fastener containing flue opening is provided for receiving the flue members. A double-walled stove bottom including a plurality of spacers thermally insulate the exposed bottom from the interior firebox.

Slip mounting to the flue opening are a number of stacked boot members which, in turn, slip mount to an overlying oven assembly having double-walled side, top and bottom walls. An associated damper control channels the smoke about the oven compartment to provide uniform heat distribution thereabout. Associated telescoping leg members further support the oven in overlying, spaced apart relation to the airtight stove. Associated dampers mounted to the oven and double-walled bottom of the stove controllably evacuate flue gases or admit combustion air.

The foregoing objects, advantages and distinctions of the subject invention, among others, as well as its detailed construction, will however become more apparent hereinafter from the following detailed description with respect to the appended drawings. Before directing attention thereto, it is to be appreciated the description is made by way of the presently preferred embodiment only, which should not in any respect be interpreted in limitation of the scope and breadth of the invention. To the extent modifications or improvements have been considered, they are described as appropriate.

DESCRIPTION OF THE PREFERRED EMBODIMENT

Figure 1:
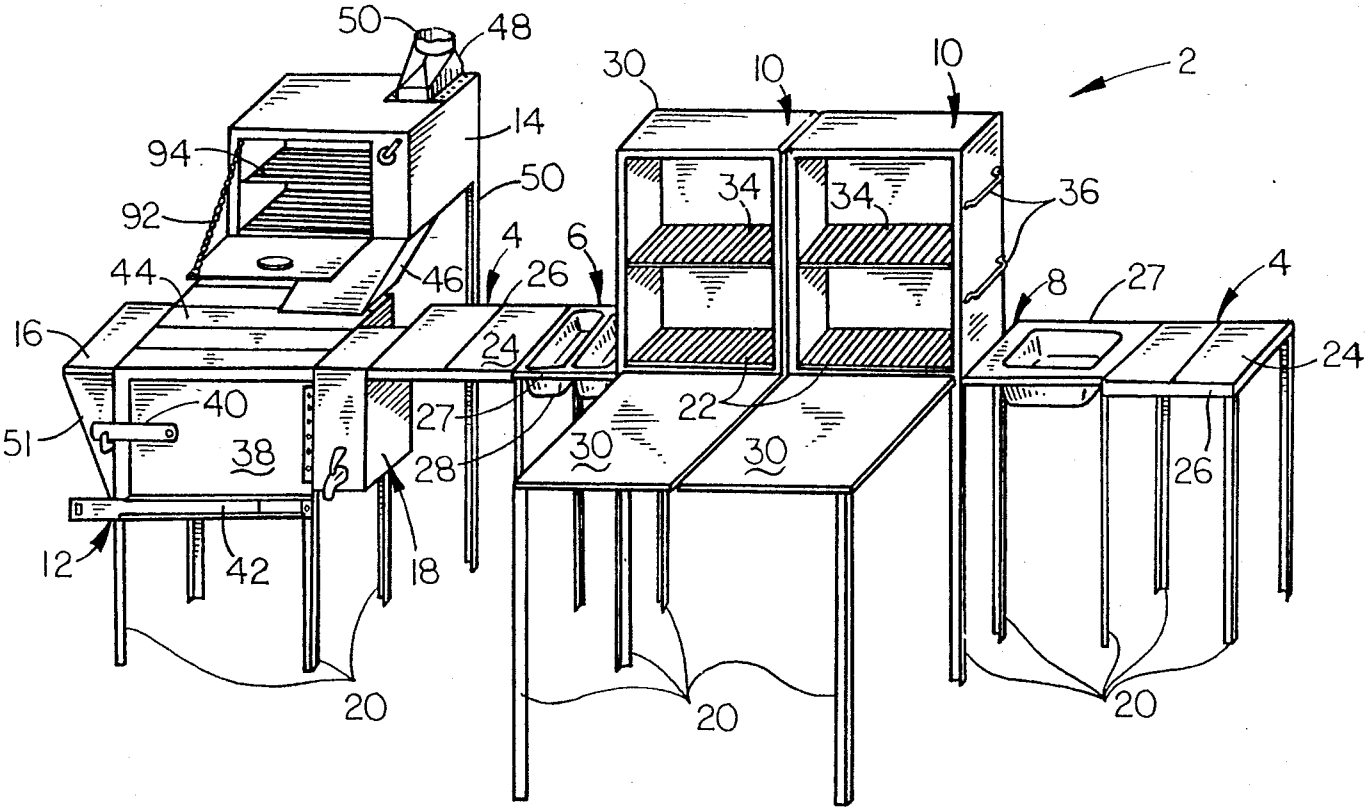
FIG. 1 shows an assembled perspective view of one kitchen arrangement of the present modularly constructed camp kitchen.

Referring to FIG. 1, an assembled perspective view is shown of a modularly arranged camp kitchen 2 which may be assembled from the components of the present invention. Generally, the kitchen shown comprises a pair of folding utility tables 4, a two-basin sink 6, a single-basin sink 8, a combination storage cabinet/utility table 10, an airtight stove 12 and a flue-mounted oven 14. Also coupled to the left and right sides of the stove 12 are a warming shelf 16 and a hinged hot water tank 18.

Each of the foregoing modular components are constructed of formed sheet metal, most typically from lightweight galvanized or stainless steel or other water or weather-resistant materials in gauge sizes in the range of 26 to 16.

Depending upon the relative position of each component within the overall kitchen, various numbers of detachable angle stock legs 20 (other than four legs per component) are slip-coupled to the corners 19 of the components for supporting the overall combination of adjacent components which are also hook-fastened to each other with mating fasteners 68 and 106, such as used with the water tank 18. That is, each unit includes a number of corner-mounted leg receiving sleeves (not shown) and opposite side mounted loop and bent latch members which mate with one another. Consequently, with the removal of the legs 20 and detachment of each unit from its neighbor, the physical size of the kitchen 2 becomes much more manageable as this relates to its storage and transport. As to the utility tables 4, they each also fold along a center hinge 26 containing top 24, which is surrounded by a formed edging that includes the leg receiving corner sleeves along its interior corner surfaces and which edging strengthens the table top 24.

The sinks 6 and 8, in turn, are constructed of formed, edge-rolled tops 27 which are fabricated with one or more ledged openings for receiving molded plastic basins. For the sink 6, two sink basins 28 are provided, while the sink 8 provides for a single basin 28. While the sink tops 27 may be constructed to accommodate a variety of basin sizes, at present 14 by 12 and 14 by 16 inch basins are preferred. Such basins are also readily obtainable from most hardware stores or the houseware sections of most department stores. Most importantly, though, upon disassembly, the sinks 6 and 8 break down to a relatively few piece parts, and along with the folded table tops 24, may be stored within various of the other components.

Also included with the present kitchen 2 is the adjustably shelved cabinet/table unit 10. Its hinged table top 30 is compound hinged via a number of piano hinges 22 to each other and the lower front edge of the cabinet section 32 to act as the cabinet doors when raised and as a table top 30 when lowered. Mounted interiorly of the cabinet section 32 are a number of adjustably positioned shelves 34 which may be suitably arranged, depending upon the dry goods, utensils, etc. normally intended therefore. Mounted to the outer sides of the cabinet 32 are a number of hinged folding handles 36. In addition to storing dry goods, it is to be appreciated the cabinet section 32 may be used for containing the folded utility tables 4, sinks 6 or 8 or their associated legs 20.

While each of the foregoing components provides convenience and makes for a well-equipped camp kitchen, the heart of the kitchen centers about the presently improved airtight stove 12 and its associated flue-mounted oven 14. Like the other kitchen components, these too are supported by a number of angle member legs 20 which sleeve mount at each corner. A latched stove door 38 covers an interior wood receiving firebox. A pivotally mounted latch arm 40 secures the door to a notched mating, side-mounted catch member and beyond which the latch 40 extends slightly to allow for the unlatching of the door with a piece of wood or other inert appliance and whereby physical contact is minimized, which is especially important when the stove is fired. At such times and due to the intended radiant construction, the stove front, side walls and top become especially hot, depending upon the size of the contained fire.

Given the airtight construction of the stove, it is to be appreciated the burn time of the fire may be readily controlled via the adjustment of the sliding, bottom-mounted damper plate 42. The plate 42 generally aligns with a hollow double-bottom cavity provided immediately beneath the firebox and whereby thermal insulation is obtained to the point that the stove bottom is generally cool to the touch, even though the remainder of the stove is untouchable and which permits the utilization of the floor space for storage. The lower portion of the firebox is also exposed via the damper plots 42 to control the admission of combustion air and permit removal of collected ash.

Slip mounted to the cooking surface 44 is an outlet or transition flue section 46 which, in turn, slip mounts to the bottom of the overlying oven 14 and from which an aligned upper flue member 48 similarly slip mounts. Each outlet is generally of a rectangular cross-sectional shape, which accommodates the slip mounting of the transition sections 46 and 48. This mounting is much more advantageously constructed and more airtight than a circular mounting, such as would otherwise be required if the remaining 5 or 6 inch round upper flue sections 50 had been coupled directly to the stove 16 or oven 14. In contrast, the formed rectangular transitions 46 and 48 are readily fabricated without undue effort and accommodate available S-type slip-mounted fasteners which will be described hereinafter. Such mountings are accommodating of the desired airtight construction in that the mating slide joint tends to seal along its length. An additional advantage of the present oven 14 construction is that a good deal of support is obtained by way of the transition flue section 46. Although, it is to be appreciated that two telescoping legs 50 are provided for additional support, which mount to the rear, overhanging portion of the oven 14.

Also mounted to the left side of the stove is the warming table 16 which is slot keyed to the stove sides and supported by end arms 51. Mounted to the right side is the water tank 18, but which will be described in greater detail hereinafter.

Figure 2:
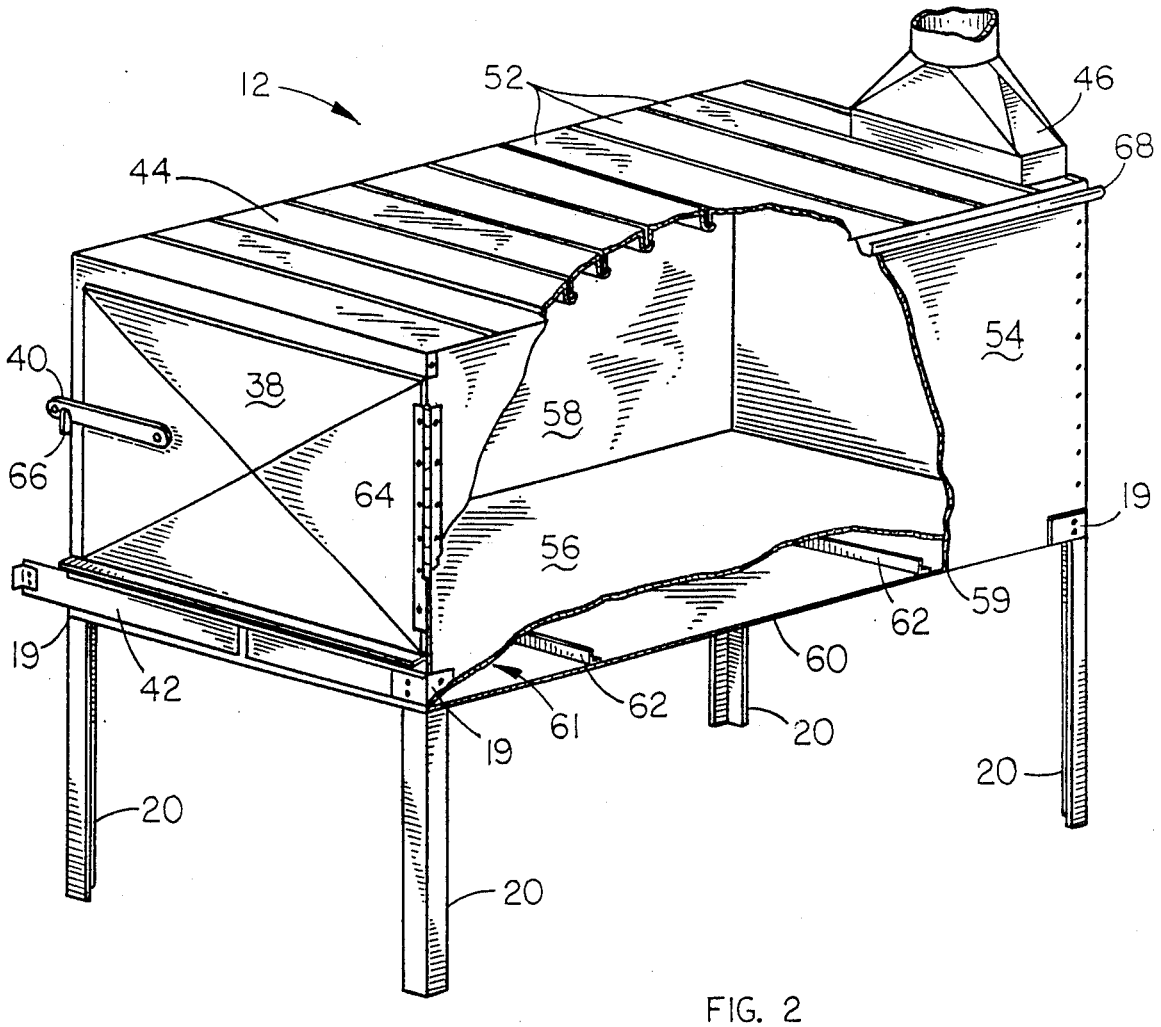
FIG. 2 shows a detailed perspective view in partial cutaway of the airtight stove of FIG. 1.

With continuing attention to FIG. 1, particular attention is next directed to FIG. 2 and wherein a detailed perspective view is shown in partial cutaway of the subject stove 12. In particular, a better appreciation is obtainable therefrom to the stove construction which, as mentioned and depending upon its size, is generally constructed of 22 or 24-gauge galvanized sheet metal, although the cook top 44 is typically constructed of 20-gauge or the next thicker size of material.

Figure 7:
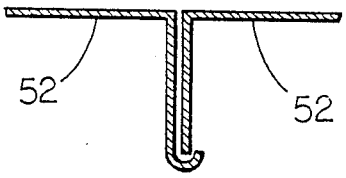
FIG. 7 shows a detached cross section view of the mounting arrangement of the stove top panels to one another.

In this latter regard and with attention to FIG. 7, it is to be appreciated the cook top 44 is comprised of a number of sections 52 having folded side edges and alternating ones of which are formed as double-folded, U-shaped slip fasteners. Thus, upon assembly, a 90-degree folded edge of one section 52 interlocks with the U-shaped edge of its neighbor. Bent 90-degree end flaps are also provided which abut against the stove side walls 54 and are each secured via at least two rivets. This construction has been found to better retain the developed heat and allow for expansion/contraction without warping.

The above cook top construction in combination with conventionally constructed side walls 54 and interior bottom wall 56 also generally form an airtight combustion compartment or firebox 58. In passing, the flaps 59 of the bottom 56 are riveted to the side walls 54 slightly above a false bottom 60 and between which bottoms 56 and 60 are mounted a number of angle members 62. The angle members 62 and the double bottom 56, 60 construction provides for a thermal barrier or air space 61, such that the temperature of the bottom 60 remains relatively cool and permits use of the floor space beneath the stove 12 for storage.

Even though the foregoing interlocking, riveted walled construction provides for an essentially airtight firebox construction, combustion air is admittable to the firebox 58. The amount of air is controllable by way of the sliding damper 42 which is slide mounted beneath the door 38 and may be moved to expose more or less of the lower portion of the firebox 58 with correspondingly more or less air being admitted to the firebox 58. Although air space 61 may also be partially exposed, this space serves no other purpose, as for example, ash collection or the like, and in normal use the firebox 58 is totally isolated from the lower air cavity. While controlled air leakage is desired at the bottom damper 42, the remaining stove seams may be sealed with an appropriate refractory sealant, although some seam leakage does prevent the fire from being extinguished when the damper is completely closed.

Turning attention to the stove door 38, it hinges to the right stove side via a length of piano hinge 64 and is again secured in its closed position via pivotally mounted latch member 40 and mating side wall mounted catch 66.

One additional feature of note is that a formed, C-shaped hinge member 68 is secured to the upper side edge of the stove and which is formed to receive a mating hinge portion on the hot water tank 18. Together, the provided hinge action provides control over the relative spacing between the tank and stove side walls 54. For example, a pop can or the like may be inserted therebetween and whereby the thermal transfer from the stove 12 and water temperature may be controlled.

Figure 3:
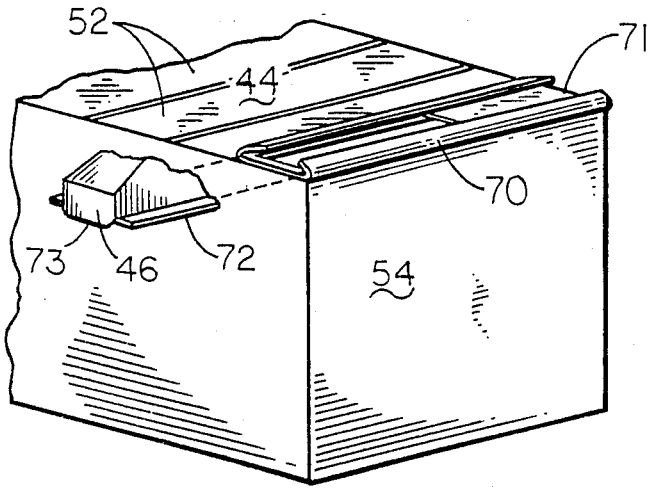
FIG. 3 shows a detailed perspective view of the slip fastener mounting of the chimney flue to the stove.

With additional attention next directed to FIG. 3, a sectioned perspective view is shown of the slip fastener 70 which is formed in the edges of the adjacent stove top section 52 and the top of the end wall 54 for receiving the flue-to-oven transition member 46. Depending upon the length of the transition member 46, a filler strip 71 may be required. Generally, the fastener sides are formed with a button lock machine which forms a number of double-folded, U-shaped bends into the top and end wall edges. The exposed channelway provided by the fasteners 70, in turn, slidably receives the mating 90-degree, double-folded outer edge flaps 72 of the transition member 46 and the outer end flaps 73 abut the stove side and filler strip 71. Thus, the transition member 46 mounts in removable sealed relation to the stove 12. During transport, the flue sections 46 and 50 may be stored within the firebox 58.

Figure 4:
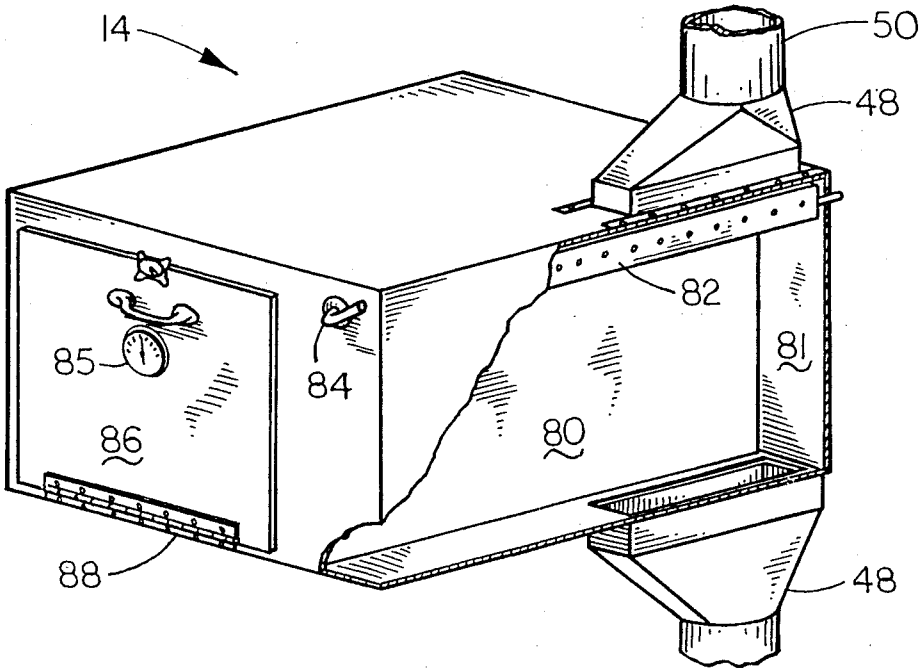
FIG. 4 shows a detailed perspective view in partial cutaway of the flue-mounted oven of FIG. 1.

Referring next to the construction of the oven 14, attention is particularly directed to FIG. 4 and wherein another detailed perspective view is shown in partial cutaway of the flue-mounted oven 14. Whereas the stove 12 provides for a double walled construction only at its bottom, the oven 14 is fabricated to provide for a concentric double walled construction about a center mounted oven cavity 80, which is riveted to flat front and back panels. Otherwise, the oven housing 80 is surrounded by a circular air cavity, which provides at least as much cross-sectional air space as provided for by the flue sections or approximately 20 to 25 square inches.

As mentioned, the flue transition members 46 and 48 slip mount to the outer walls of the oven in the same manner as depicted in FIG. 3 for the stove 12. For the oven shown, the transition members 46 and 48 particularly mount to the right side of the oven and, consequently, a slightly larger cavity 81 is provided thereat than at the space surrounding the top, bottom and left side.

Mounted intermediate each transition member 46 and 48 is a pivotally mounted rectangular damper member 82, the position of which is controlled via an exposed handle member 84. Where a relatively high baking temperature is desired, the damper 84 is rotated to its most closed position, although space is provided for flue gases to pass around the damper 84, which reduces creosote buildup. This position also induces the greatest portion of the gases to be directed around the bottom, side and top of the cavity 80, thereby warming the related cavity walls, before the gases escape by way of the transition member 48 and chimney flue sections 50. The interior oven temperature may be monitored by way of a door-mounted thermometer 84.

Consequently, the cook, by controlling the fire and/or position of the damper 84, can regulate the oven temperature. Additionally, baked foods may be controllably positioned within the oven on provided oven racks 94, although generally a uniform heating is provided within the oven.

The oven door 86 itself is mounted to the oven 14 by way of a lower hinge member 88 and may be opened/-closed by way of handle 90. Also included is at least one chain support 92 which can be seen in FIG. 1 relative to the interiorly mounted racks 94.

Figure 5:
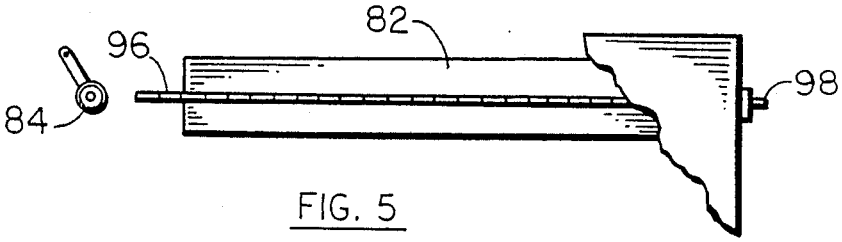
FIG. 5 shows a disassembled, sectioned elevation view of the oven damper control.

Referring also to FIG. 5, a detailed elevation view is shown of the damper member 82 which, as mentioned, generally comprises a rectangular strip of metal, including a center elongated pivot 96 and the rightmost end of which is mounted in a sealed end cap 98 secured to the outer oven wall and which acts as a bearing support. The leftmost end, in turn, is threaded to receive and secure the control latch 84 in rotative relation to the front oven wall.

Figure 6:
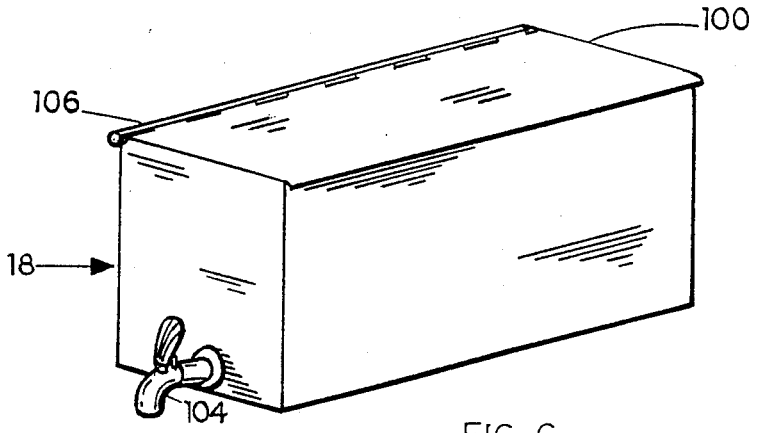
FIG. 6 shows a perspective view of the hot water tank which mounts to the stove of FIG. 1.

Lastly, attention is directed to FIG. 6 and wherein a perspective view is shown of the hot water tank 18. Generally, it is constructed as a rectangular watertight enclosure, the top 100 of which is hinge mounted thereto. A spigot 102 is fastened to the front of the tank 18 and allows for controlled draw-off of heated water. Also formed as part of the upper left edge of the tank is a C-shaped hinge member 106 which mounts in mating relation to the hinge portion 68 secured to the stove 12. As mentioned, water temperature is controllable by adjusting the spacing of the tank 18 to the stove walls.

While the present invention has been described with respect to its presently preferred embodiment and various alternative embodiments and modifications, it is to be appreciated that still other modifications may suggest themselves to those of skill in the art. It is accordingly contemplated that the following claims should be interpreted so as to include all those equivalent embodiments within the spirit and scope thereof.

What is claimed is:

1. Portable, stowable camp kitchen apparatus comprising:

(a) a multi-walled sheet metal wood burning stove comprising;
  (i) a pair of vertical side walls,
  (ii) a rear end wall,
  (iii) a front wall having a latchable hinged door opening to a fire box and a slidale door mounted beneath the latchable door and opening to at least a lower portion of said fire box,
  (iv) an external bottom wall,
  (v) an imperforate interior bottom wall defining the bottom of the firebox and dividing the fire box from an air cavity between the internal and external bottom walls,
  (vi) a cook top comprised of a plurality of elongated panels assembled to form an essentially airtight cooking surface, each panel having a flat horizontal portion and formed peripheral edges, wherein one edge is bent to a U-shape and an opposite edge is bent to slip mount within the U-shaped edge of an adjacent panel and wherein others of said edges are rigidly secured to the stove walls, and including an aperture to the fire box circumscribed by a plurality of flange members; and (b) a flue member, at least one end of which includes a flange portion transversely mating with the circumscribing flange members and whereby combustion gases are exhausted from said fire box.

2. Portable, stowable camp kitchen apparatus comprising:

(a) a multi-walled sheet metal wood burning stove comprising;
  (i) a pair of vertical side walls,
  (ii) a rear end wall,
  (iii) a front wall having a latchable hinged door opening to a fire box and a slidable door mounted beneath the latchable door and opening to at least a lower portion of said fire box,
  (iv) an external bottom wall,
  (v) an imperforate interior bottom wall defining the bottom of the firebox and dividing the fire box from an air cavity between the internal and external bottom walls,
  (vi) a cook top comprised of a plurality of elongated panels assembled to form an essentially airtight cooking surface, each panel having a flat horizontal portion and formed peripheral edges, wherein one edge is bent to a U-shape and an opposite edge is bent to slip mount within the U-shaped edge of an adjacent panel and wherein others of said edges are rigidly secured to the stove walls, and including an aperture to the fire box circumscribed by a plurality of flange members;

(b) a flue member, at least one end of which includes a flange portion transversely mating with the circumscribing flange members and whereby combustion gases are exhausted from said fire box;

(c) a plurality of hinge members secured to ones of the walls of said stove;

(d) a plurality of leg sockets secured to ones of the walls of said stove; and (e) a plurality of leg members mountable in ones of said leg sockets for supporting said stove.

3. Apparatus as set forth in claim 2 including a table top having a plurality of leg sockets and at least one mating hinge member to the stove hinge members, whereby the table top is detachably mountable to said stove and is supported from shared ones of said leg members.

4. Apparatus as set forth in claim 3 including a sink having at least one basin, said sink comprising a metal-formed top having an aperture therethrough for receiving and supporting a plastic basin inserted through said aperture and having a plurality of leg sockets and at least one mating hinge member, whereby the table top is detachably mountable to said camp kitchen apparatus and is supportable from shared ones of said leg members.

5. Apparatus as set forth in claim 3 including a utility storage cabinet comprising a metal walled enclosure having a door hinge mounted along a lower cabinet edge, and further having a plurality of leg sockets and at least one mating hinge member whereby the table top is detachably mountable to said camp kitchen apparatus and supportable from shared ones of said leg members.

6. Portable, stowable camp kitchen apparatus comprising:

(a) a multi-walled sheet metal wood burning stove comprising;
  (i) a pair of vertical side walls,
  (ii) a rear end wall,
  (iii) a front wall having a latchable hinged door opening to a fire box and a slidable door mounted beneath the latchable door and opening to a portion of said fire box, (iv) an external bottom wall, (v) an imperforate interior bottom wall defining the bottom of the firebox and dividing said fire box from an air cavity beneath said fire box, (vi) a cook top comprised of a plurality of elongated panels assembled to form an essentially airtight cooking surface, each panel having a flat horizontal portion and formed peripheral edges wherein one edge is bent to a U-shape and an opposite edge is bent to slip mount within a U-shaped edge of an adjacent panel and wherein others of said edges are rigidly secured to the vertical side walls, said cook top including an aperture to the fire box located inward from a peripheral edge and wherein at least opposite edges of said aperture each include a flange member secured to said cook top;

(b) first and second flue members, at least one end of each of which includes a flange portion;

(c) an oven comprising:

(i) an external enclosure having inlet and outlet orifices located inwards from a peripheral edge of top and bottom walls of the external enclosure, and wherein at least opposite edges of each of the inlet and outlet orifices include a flange member for a slidably receiving the mating peripheral flanged portions of one of said flue members and such that said first flue member is slidably securable between said cook top aperture and said inlet orifice and said second flue member is securable to said outlet orifice, (ii) a baking compartment having a hinged access door and mounting through a wall of said external enclosure such that a combustion gas conduit in communication with said inlet and outlet orifices is created between said baking compartment and the external enclosure, and (iii) damper means for directing flue gases within said combustion gas conduit;

(d) first and second elongated hinge members, each mounted along an external stove wall;

(e) a watertight tank having a hinged cover and means for drawing water from said tank and including a mating hinge member whereby said tank is pivotally removably securable to said first hinge member;

(f) a table top having a mating member whereby said table top is pivotally removably securable to said second hinge member;

(g) a plurality of leg sockets secured to at least the bottom of each of said stove and oven; and (h) a plurality of leg members mountable in ones of said leg sockets.

7. Portable, stowable camp kitchen apparatus comprising:

(a) a multi-walled sheet metal wood burning stove comprising;

(i) a pair of vertical side walls, (ii) a rear end wall, (iii) a front wall having a latchable hinged door opening to a fire box and a slidable door opening to at least a lower portion of said fire box, (iv) an imperforate, external bottom wall, (v) an imperforate interior bottom wall defining the bottom of the firebox and spaced away from said external bottom wall via a plurality of support members resting on an interior surface of the external bottom wall and whereby an air cavity is created beneath said fire box, (vi) a cook top comprised of a plurality of elongated panels assembled to form an essentially airtight cooking surface, each panel having a flat horizontal portion and formed peripheral edges wherein one edge is bent to a U-shape and an opposite edge is bent to slip mount within a U-shaped edge of an adjacent panel and wherein others of said edges are rigidly secured to the vertical side walls, said cook top including an aperture to the fire box located inward from a peripheral edge of said cook top and wherein at least opposite edges of said aperture each include a flange member secured to said cook top;

(b) first and second flue members, at least one end of each of which includes a peripheral flange portion; and (c) an oven comprising:

(i) an external enclosure including inlet and outlet orifies wherein each of the inlet and outlet orifices are circumscribed by a plurality of flange members and whereat the first flue member is slidably securable between said cook top aperture and said inlet orifice and said second flue member is securable to said outlet orifice, (ii) a baking compartment having a hinged access door, said baking compartment mounted interiorly through a wall of said external enclosure such that a combustion gas conduit in communication with said inlet and outlet orifices is created between the baking compartment and the external enclosure, and (iii) means for directing said flue gases within said combustion gas conduit.

* * * * *